United States Patent [19]

SäE,uml/a/ f et al.

[11] Patent Number: 4,515,141

[45] Date of Patent: May 7, 1985

[54] ARRANGEMENT FOR IGNITION MEANS IN A MULTI-CYLINDER INTERNAL COMBUSTION ENGINE

[75] Inventors: Lars L. SäE,uml/a/ f, Södertälje; Lars E. Bergsten, Järna, both of Sweden

[73] Assignee: Saab-Scania Aktiebolag, Södertälje, Sweden

[21] Appl. No.: 571,096

[22] Filed: Jan. 16, 1984

[30] Foreign Application Priority Data

Jan. 17, 1983 [SE] Sweden ..... 8300190

[51] Int. Cl.[3] ..... F02B 77/00

[52] U.S. Cl. ..... 123/647; 123/198 E; 123/198 R

[58] Field of Search ..... 123/647, 198 E, 198 R

[56] References Cited

U.S. PATENT DOCUMENTS

| | | | |
|---|---|---|---|
| 1,847,899 | 7/1929 | Rabezzana | 123/647 |
| 2,577,308 | 12/1951 | Carson | 123/198 E |
| 2,625,146 | 1/1953 | Stephens | 123/198 E |
| 2,724,378 | 9/1951 | Wellman | 123/198 E |
| 3,396,712 | 8/1968 | Sakraida et al. | 123/198 E |
| 3,996,914 | 12/1976 | Crall et al. | 123/198 E |
| 4,404,951 | 9/1983 | Zechlin et al. | 123/647 |

FOREIGN PATENT DOCUMENTS

| | | | |
|---|---|---|---|
| 760104 | 10/1952 | Fed. Rep. of Germany | 123/198 E |
| 3009302 | 9/1980 | Fed. Rep. of Germany | 123/198 E |
| 7906056-2 | 7/1979 | Sweden | 123/198 E |

*Primary Examiner*—Raymond A. Nelli

*Attorney, Agent, or Firm*—Cushman, Darby & Cushman

[57] ABSTRACT

An arrangement for protecting ignition means in an internal combustion engine includes a cylinder head and two longitudinal parallel valve cover banks mounted thereon. Between the valve cover banks there is a longitudinal space for ignition means to the respective combustion chambers of the engine. Such a space and ignition means with their connections located therein are usually subjected to dirt, which reduces the functional reliability of the engine. To eliminate this and to facilitate engine service, the space is formed as a trough with a bottom and two end walls in the cylinder head, the trough being covered by a lid joining on to the valve cover banks and to at least one of its end walls and having at least one opening for ventilation and drainage.

10 Claims, 2 Drawing Figures

ARRANGEMENT FOR IGNITION MEANS IN A MULTI-CYLINDER INTERNAL COMBUSTION ENGINE

Figure 1:
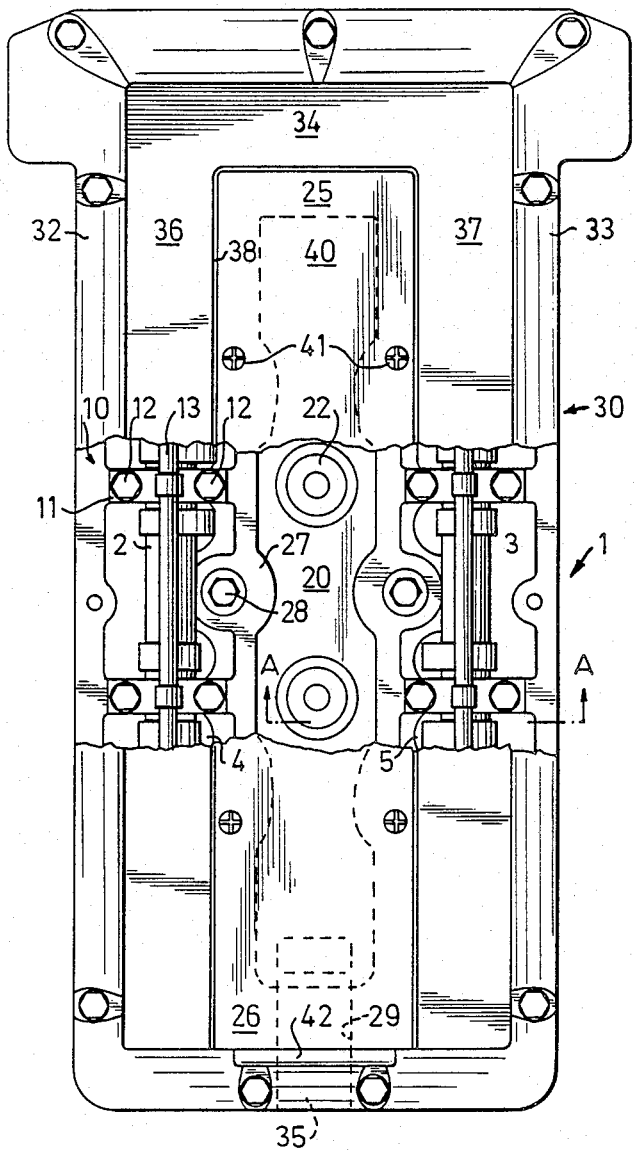

The present invention relates to an arrangement for protecting ignition means in a multi-cylinder internal combustion engine, including a cylinder head and two longitudinal, parallel valve cover banks mounted thereon, a longitudinal space for the ignition means to the combustion chambers of the engine being arranged between the valve cover banks.

Internal combustion engines with the cylinders arranged in a V, as well as in-line engines with dual overhead cam shafts often have a space between the valve covers enclosing the cam shafts of the engine and coating valve mechanisms. The space mentioned usually accommodates means connected to the engine, e.g. injection and/or ignition means etc. Necessary connections to said means such as lines, cables and the like may give an impression of disorder as seen from the outside. Furthermore, the connections are exposed to dirt, oil, moisture and the like, and since the space is generally difficult to keep clean, the result is increased risk for functional disturbances. There is also the risk that particles of dirt can fall down into the engine cylinders when the ignition means are removed during service work. The connections are usually unprotected, which can cause unintentional hook-ups with tools and the like during service and repair work.

The present invention has the object of eliminating these disadvantages, and relates to arranging space for the ignition means to the combustion chambers of the engine in a multi-cylinder internal combustion engine, the invention being mainly distinguished in that the space is formed as a trough with a bottom and two end walls in the cylinder head, in that the trough is covered by a removable lid joining on to the two valve cover banks and on to at least one end wall of the trough, and in that the trough is formed with at least one opening for ventilation and drainage.

The inventive solution enables concealed and protected laying of the lines to the ignition means, and both the lines and the ignition means are protected from dirt, moisture etc. coming from outside. The risk of condensation in the trough enclosed by the lid is also eliminated by the ventilation opening provided. In a preferred embodiment, the ventilation opening constitutes a passage cast into the cylinder head, this passage starting from the bottom of the trough and opening out on the outside of one end wall of the cylinder head. There are thus avoided collections of condensed water or oil resulting from leakage, e.g. between the valve cover and cylinder head, which otherwise could lead to functional disturbances.

Remaining features distinguishing the invention will be apparent from the appended claims and following description of an embodiment exemplifying the invention. The description is performed with reference to the appended figures, of which FIG. 1 is a view from above of an Otto engine, with a partially cut-away valve cover, and FIG. 2 is an end view of the cylinder head of the Otto engine according to FIG. 1 with a partially cut-away end wall.

The figures illustrate a cylinder head for an in-line engine having dual overhead cam shafts 2,3 where one cam shaft 2 is arranged to control the exhaust valves 4 and the other cam shaft 3 is arranged to control the inlet valves 5. For this purpose the cam shafts 2,3 are formed with a number of cams 7 actuating the valves 4,5 via valve pushers 8 and against the bias of valve springs 9. The valves 4,5 conventionally coact with the engine combustion chambers 6, of which one is illustrated by a dashed line in FIG. 2.

The cam shafts 2,3 are journalled in a plurality of bearings 10 in the cylinder head 1 which is cast in one piece. At each bearing 10 the cam shaft 2,3 is enclosed by a bearing cap 11, fastened to the cylinder head 1 by two screws 12. An oil distribution pipe 13 connected to the respective bearing cap 11 ensures satisfactory lubrication of the bearing. The bearings 10 are placed such that they lie between two exhaust or inlet valves assigned to one and the same combustion chamber 6. A trough 20 is formed in the cylinder head 1 between the cam shafts 2,3 and in its bottom 21 there are arranged a number of wells 22, one for each combustion chamber 6. A spark plug 23 (see FIG. 2) is arranged in each well 22. Each well is formed with an upper collar 24 joining on to the bottom 21 of the trough. Such collars 24 prevent water, oil and the like, which possibly may be present, from running down into the wells 22.

Figure 2:
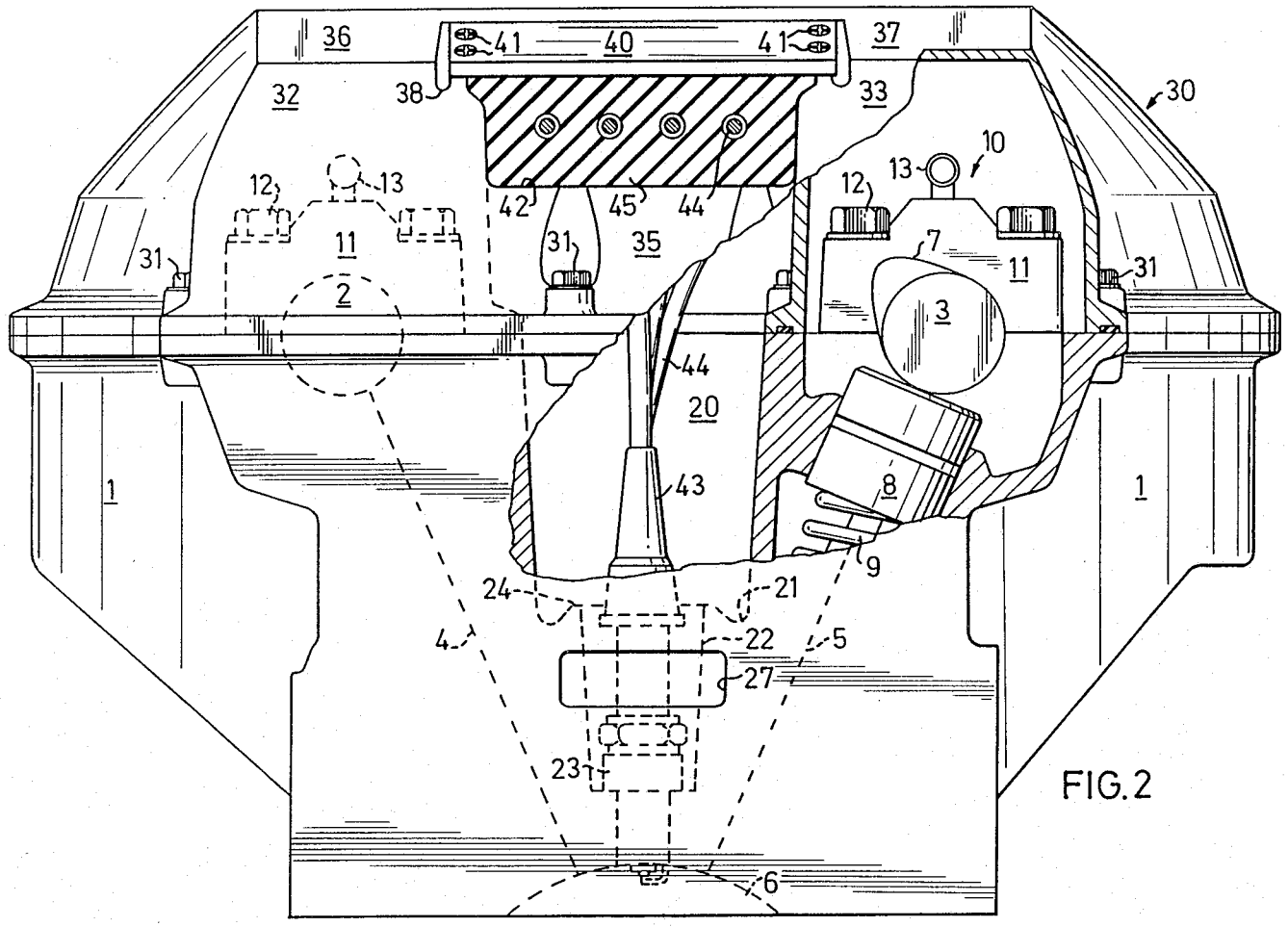

As will be seen from FIG. 1, the trough 20 in the cylinder head 1 is formed with two end walls 25,26 and a number of transverse constrictions 27. These constrictions 27 reinforce the cylinder head, and in them are arranged screws 28 for fastening the cylinder head 1 to a cylinder block not illustrated. From one end of the trough 20 at its bottom 21 there departs a ventilation and drainage passage 29 opening out into the outer end wall of the cylinder head 1 at a level which is lower than the bottom level of the trough 20.

The upper part of the trough 20 is limited in the horizontal plane on all sides by a valve cover 30, which is attached to the cylinder head 1 by a number of screws 31. The valve cover 30 comprises two longitudinal banks 32,33 for covering the respective cam shafts 2,3, and is also provided at one end with a communicating, extended portion 34 joining the banks together and thereby enclosing a cam shaft drive not illustrated. A portion 35 connecting the other ends of the banks 31,32 is sunken relative the upper defining surfaces 36 and 37 of the banks 32,33. Said surfaces 36,37 are situated in a common plane sloping downwards towards the other end of the valve cover 30 from said extended cover portion 34. The upper defining surfaces 36,37 of the banks 32,33 do not need to be planar, however, but may to advantage be provided with longitudinal grooves improving the ability of possible liquid on the engine to run off, and furthermore facilitating heat dissipation from the cylinder head.

At the inner edge of the banks 32,33 and the extended cover portion 34 there is a groove 38 surrounding a lid 40 on three sides. The lid 40 is intended to close off the trough 20 and to be attached to the valve cover 30 with the aid of a number of screws 41.

Between the lid 40 and the sunken portion 35 at the other end of the valve cover 30 there is an opening 42, utilized for the entry of ignition cables 44 connected via connection means 43 to the spark plugs 23 in the trough 20. The opening 42 is sealed off with the aid of a rubber seal 45 or the like, which simultaneously constitutes a holder for the ignition cables 44. The lid 40 is to advantage situated in substantially the same plane as the upper limiting surfaces 36,37 of the banks 32,33. As with the banks, the lid 40 can be provided with longitudinal grooves. Neither is the possibility of providing the lid 40 with ventilation openings to be overlooked, although these openings should as far as possible not allow the penetration of liquid. For the purpose of keeping the ignition cables in place and spaced both to each other and to surrounding trough walls, the cables are preferably clamped by unillustrated holders situated immediately beneath the lid 40. The holders are suitably attached to the valve cover banks 32,33 and may also be utilized for attaching the lid to said banks.

In the area around each spark plug well 22, the trough 20 is dimensioned to allow access by hand to the spark plug 23 and the connection means 43 mounted thereon. A standard type of connection means 43 may be used without any requirement of extra length.

Within the scope of the invention, the ignition cables 44 and the lid 40 may be replaced by a so-called ignition pack. This may be formed as a unit with connection means to all the spark plugs. The unit has an upper defining plane which can be regarded as replacing the lid 40, and contact between the connections and the spark plugs is ensured by the unit being screwed to the surrounding valve cover 30. To advantage, the pack is included as a part of an ignition system described in the Swedish patent application No. 8204248-2, the pack thus entirely enclosing the hightension part of the ignition system.

The solutions described above should not be regarded as restricting the invention, which may be modified into other embodiments within the scope of the following claims.

What we claim is:

1. An arrangement for protecting ignition means in a multi-cylinder internal combustion engine, including a cylinder head and two longitudinal, parallel valve cover banks mounted thereon, a longitudinal space for the ignition means to the combustion chambers of the engine being arranged between the valve cover banks and defined by the opposing surfaces of the valve cover banks wherein the longitudinal space is a trough having a bottom, two side walls and front and rear end walls formed within the cylinder head, the trough being covered by a removable lid joining on to both valve cover banks and on to at least one end wall of the trough, and in that the trough is formed with at least one opening in the cylinder head for ventilation and drainage.

2. An arrangement as claimed in claim 1, characterized in that the valve cover banks are connected to each other at their ends with the aid of transverse wall portions constituting a portion of the end walls of the trough.

3. An arrangement as claimed in claim 2, characterized in that one end wall of the trough is formed with an opening through which conducting connections are taken to the ignition means.

4. An arrangement as claimed in claim 3, characterized in that the conducting connections are taken through a seal mounted in the opening.

5. An arrangement as claimed in claim 1, characterized in that the bottom of the trough is formed with a number of wells for mounting the ignition means.

6. An arrangement as claimed in claim 5, characterized in that the wells are formed with upstanding collars joining on to the bottom of the trough.

7. An arrangement as claimed in claim 6, characterized in that the bottom of the trough is formed with a width which, at least in the area about said wells, allows manual access to the ignition means.

8. An arrangement as claimed in claim 1, characterized in that the ventilation and drainage opening includes a passage cast into the cylinder head and opening out in one end wall of the cylinder head at a level which is lower than the bottom level of the trough.

9. An arrangement as claimed in claim 3 characterized in that the lid is attached to the upper opposing surfaces of the valve cover banks and one end wall portion.

10. An arrangement as claimed in claim 1, characterized in that the lid is integrated into an ignition pack connectible as a unitary pack to ignition means mounted in the wells of the trough.

* * * * *